US005480278A

United States Patent [19]

Morgan

[11] Patent Number: 5,480,278

[45] Date of Patent: Jan. 2, 1996

[54] AUTOMATIC STACKER APPARATUS AND METHOD

[75] Inventor: Robert K. Morgan, Boulder, Colo.

[73] Assignee: MBT Corporation, Boulder, Colo.

[21] Appl. No.: 292,350

[22] Filed: Aug. 17, 1994

[51] Int. Cl.[6] ..... B65G 57/03

[52] U.S. Cl. ..... 414/790.3; 414/789.8; 414/924; 414/926

[58] Field of Search ..... 414/794.4, 789.8, 414/789.9, 790.3, 924, 926, 794.6

[56] References Cited

U.S. PATENT DOCUMENTS

| | | | |
|---|---|---|---|
| Re. 23,641 | 4/1953 | Andren et al. . | |
| 2,497,149 | 2/1950 | Berdis et al. . | |
| 2,672,079 | 3/1954 | Chandler . | |
| 2,738,116 | 3/1956 | Barraclough et al. . | |
| 2,937,482 | 5/1960 | Lazott et al. | 414/790.3 |
| 3,106,302 | 10/1963 | Mandonas | 414/794.4 |
| 3,129,825 | 4/1964 | Lamb | 414/926 |
| 3,297,174 | 1/1967 | Letchworth . | |
| 3,659,728 | 5/1972 | Relnecke . | |
| 3,748,797 | 7/1973 | Deines . | |
| 3,812,647 | 5/1974 | Bertling et al. | 414/794.4 |
| 3,866,741 | 2/1975 | Carbon et al. . | |
| 3,959,951 | 6/1976 | Paules . | |
| 4,236,855 | 12/1980 | Wagner et al. . | |
| 4,902,184 | 2/1990 | Fritz . | |
| 4,955,794 | 9/1990 | Fluck | 414/924 |
| 5,116,195 | 5/1992 | Pattarozzi . | |

*Primary Examiner*—Michael S. Huppert
*Assistant Examiner*—Douglas A. Hess
*Attorney, Agent, or Firm*—Francis A. Sirr; Earl C. Hancock

[57] ABSTRACT

Apparatus for frozen patties wherein one wide and slow conveyor feeds a plurality of narrow and fast conveyors to spread out the patties prior to stacking. Each fast conveyor conveys a stream of patties to a stacking module, each module includes a vertically-extending stacking cylinder. Each stacking cylinder includes a vertically-movable plunger which decrements as a patty is added to the top of the cylinder. When a cylinder contains enough patties for a stack, a patty-blocking member blocks patties from entering that fast conveyor, and the plunger in that cylinder raises the stack vertically out of the cylinder to a horizontal stage platform. A pusher member pushes the stack off the plunger and onto the stage platform. Vertically-hanging spring leaves stabilize the position of the stacks on the stage platform. When a desired number of stacks have accumulated on the stage platform, the stacks are moved to a collection station. If a problem occurs in any stacking modules, patty flow is blocked, the fast conveyor feeding the module is stopped, the plunger in the corresponding cylinder is lowered to the bottom of that cylinder, and that cylinder is moved horizontally to overhang a purge chute. Any patties then in the cylinder drop into the purge chute. The cylinder returns to a position relative to its fast

20 Claims, 7 Drawing Sheets

AUTOMATIC STACKER APPARATUS AND METHOD conveyor, the conveyor is-started to send patties thereon into the cylinder, and the cylinder moves to the purge chute.

BACKGROUND OF THE INVENTION

1. Field of the Invention

This invention relates to apparatus and methods for automatically forming a vertical stack of relatively thin flat objects, all of which have generally the same horizontal shape and area. More specifically, this invention relates to apparatus and methods for automatically forming stacks of disk shaped, square shaped, rectangular shaped, or irregularly-shaped flat objects such as frozen hamburger or sausage patties.

2. Description of the Related Art:

It is known in the art to feed frozen patties into chutes, to thereby form stacks of patties. Generally, it is necessary for a worker to count the patties, and then place them into a stack within a box. This manual work is boring and repetitive, and necessarily takes place in a cold and noisy environment. The workers are thereby prone to injuries, such as carpel tunnel syndrome, and absenteeism and turnover are high.

The stacking device art includes Reissue U.S. Pat. No. 23,641 wherein paper sheets entering a stack are counted prior to the sheets hitting a fixed abutment, the sheets then dropping down onto a stack. U.S. Pat. Nos. 2,497,149, 2,672,079, 2,738,116, 3,659,728, 3,866,741, 4,902,184, and 5,116,195 are generally similar in their teaching.

In U.S. Pat. No. 3,297,174, a plurality of parallel conveyors feed a stacker apparatus. U.S. Pat. No. 3,748,797 describes an accumulator and boxer wherein a slow conveyor feeds a fast conveyor.

In U.S. Pat. No. 3,959,951, frozen patties are stacked onto a piston that moves downward as patties are stacked thereon. As the patties enter the stacking area, they strike a retaining guide member, as a top disposed piston at this location prevents upward movement of the patties. U.S. Pat. No. 4,236,855 also deals with the stacking of hamburger patties.

While devices as above described are generally useful for their limited intended purposes, the need remains for an automatically apparatus and method that accurately forms uniform vertical stacks of frozen patties as the patties exit a processing machine (for example, a freezing station).

SUMMARY OF THE INVENTION

This invention provides an automatic apparatus and method for stacking flat objects, such as frozen hamburger patties, as the patties exit a freezing station, or the like, while being carried by a relatively slow speed warehouse conveyor. A higher speed buffer conveyor picks up the frozen patties from the warehouse conveyor, and transports the patties to a plurality of fast conveyors, one fast conveyor of which is associated with each of a like plurality of stacking stations constructed in accordance with the invention.

Each stacking station includes an open top, open bottom, vertically-extending metal stacking cylinder containing a vertically-movable plunger that is stepped vertically downward a selected distance as patties enter the cylinder. A patty detector is associated with the fast conveyor that feeds each stacking cylinder. This detector detects passage of a patty on its way to a stacking cylinder, and operates to feed a patty-detected signal to a controller. As a result, the controller operates to move the plunger down a distance generally equal to the thickness of a patty.

When a given number of patties have been stacked in the cylinder, as is determined, for example, by counting the output signals from the patty detector, weighing the stack or directly measuring the vertical height of the stack, a patty blocking member that is associated with the fast conveyor feeding that cylinder is operated by the controller to block passage of patties along that fast conveyor. The plunger in that cylinder is now raised out of the top of the cylinder, to the vertical height of a stage platform. A stack pusher member now pushes the accumulated stack of patties off of the plunger and onto the stage platform.

The plunger is then lowered, patty blocking is disabled, and patty stacking begins again.

As a feature of the invention, a resilient spring or force member is associated with the exit end of the fast conveyor, and cooperates with the top surface of a passing patty, a horizontally-movable lid is associated in spaced relation with the top of the stacking cylinder, and the top wall of the stacking cylinder that is downstream of patty movement includes a vertically-extending lip against which the leading edge of the patties abut as they enter the cylinder, all three of which features aid in the orderly stacking of patties in the cylinder.

In accordance the invention, the above-mentioned controller operates to move the lid horizontally to the side before the stack is elevated to the stage platform, and the lid is moved back into place over the open top of the cylinder when stacking begins again.

As another feature of the invention, and when a stack is moved up to the stage platform, the upstream vertical wall of the cylinder from which patties enter the cylinder includes a vertically-movable gate that is moved up into the patty path as patty flow to the cylinder is blocked by operation of the patty blocking member. This gate, when in its raised position, operates to stabilize or hold the side of the stack as the stack is being raised to the level of the stage platform. Again, this gate is lowered back into place adjacent to the vertical side of the stacking cylinder when stacking begins again.

A feature of the invention provides a cylinder purge cycle wherein, under certain malfunction conditions, any patties in the cylinder are selectively purged to a discard station or container. On initial startup, a cylinder purge is performed before the above-mentioned patty stacking begins. Thereafter, the output of the above-mentioned patty detector is monitored to determine if a patty is blocking the patty sensing station. This event is detected, for example, by sensing that sensing a patty has not been followed in a short time interval by the event of sensing the absence of a patty. When this malfunction is detected, it is determined that a patty flow malfunction has occurred and that a cylinder purge cycle should be performed. More specifically, when an excessive time interval passes before the patty sensor indicates that a patty has successfully passed the patty sensing station, the patty blocking member is activated, and the fast conveyor that is associated with that patty sensor is stopped. The plunger in the associated stacking cylinder is now moved out of the bottom of the cylinder, and the cylinder is moved horizontally a short distance to the location of a sloped and vertically-extending purge chute. Any patties now resident in the cylinder fall vertically downward out of the bottom of the cylinder, and are guided by the chute to the location of a discard station. The cylinder is now moved horizontally back into stacking position, the fast conveyor is started for a time period to purge the conveyor, a cylinder purge is repeated, timers and counters are reset, and the patty blocking member is deactivated, to thereby again begin patty stacking in the cylinder.

In association with the above-mentioned cylinder purge operation, the invention operates to automatically indicate apparatus malfunction if an excessive number of purge cycles are performed in a given time period.

These and other objects, features and advantages of the invention will be apparent to those of skill in the art upon reference to the following detailed description of the invention, which detailed description makes reference to the drawing.

DETAILED DESCRIPTION OF THE PREFERRED EMBODIMENTS

Figure 1:
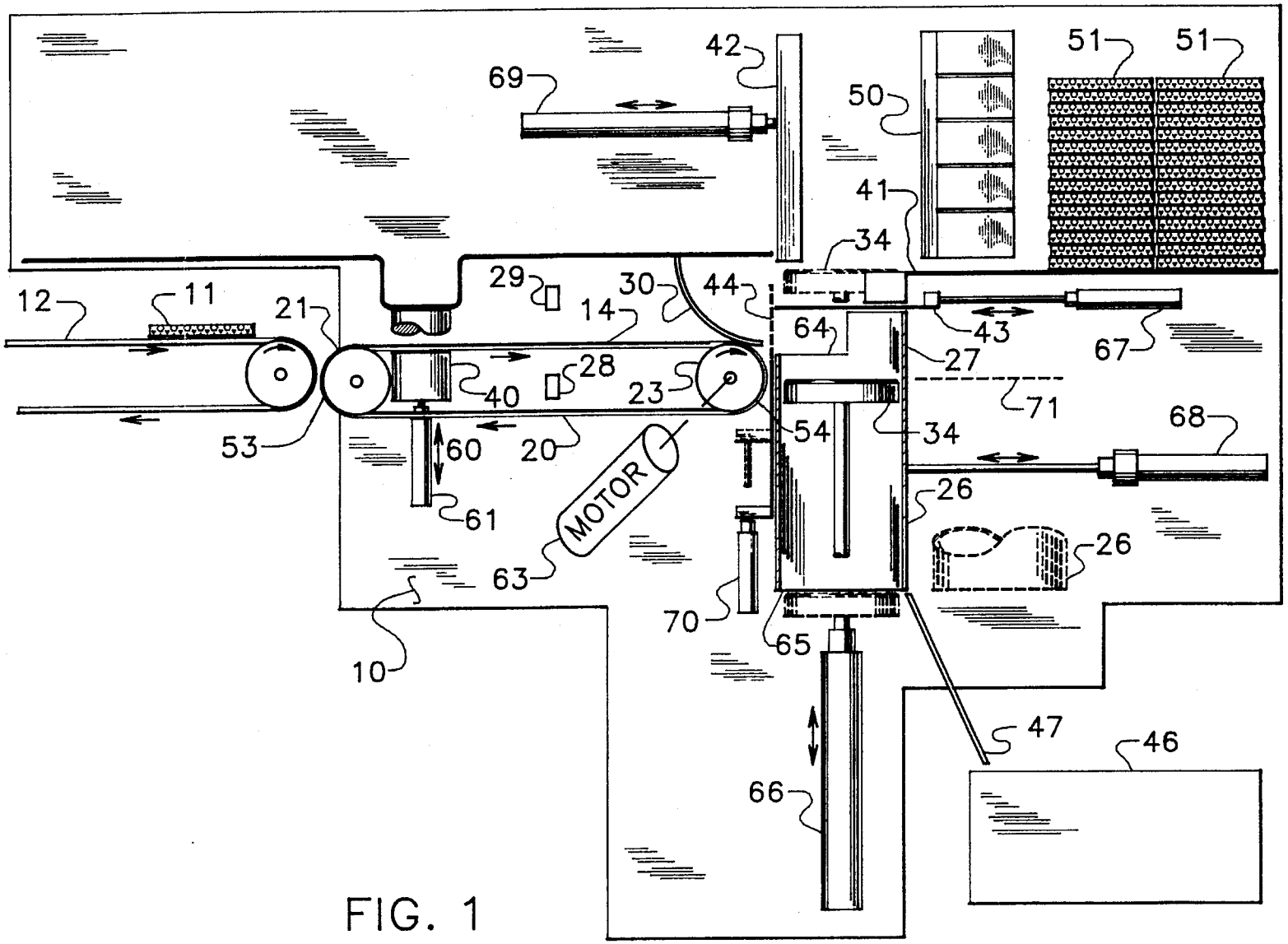
FIG. 1 is a side view of one of six stacking stations or modules in accordance with the invention.

FIG. 1 is a side view of one of six identical frozen patty stacking stations, or modules 10, in accordance with the invention. While an embodiment of the invention provided six such stacking modules, it is within the spirit and scope of the invention to provide more or less than this number of parallel operating modules. This invention provides an automatic apparatus 10 for stacking flat objects, such as hamburger patties 11, as the patties exit a processing station, such as a freezing station (not shown) on a horizontal, relatively slow speed, warehouse belt conveyor 13 that is shown in the top view of FIG. 2. A higher speed buffer belt conveyor 12 picks up frozen patties 11 from warehouse conveyor 13, and transports patties 11 to six parallel, side by side, fast belt conveyors 14, one fast conveyor 14 of which is associated with each of the six stacking stations 10 constructed in accordance with the invention.

In accordance with a feature of the invention, the six individual patty stacking modules that are each fed by one of the six fast conveyors 14, operate fast enough to handle the entire patty throughput of warehouse conveyor 13, even when one or more of the modules are out of service for the purpose of periodic maintenance, and the like. The modularity of construction of the stacking modules, as will be apparent in accordance with the invention, makes module maintenance fast and easy. The design of the stacking cylinder of each module allows the modules to accommodate a relatively large variation in patty diameter, and the manner in which the stacking plunger in each stacking cylinder is controlled in its downward movement allows each module to accept a relatively large variation in vertical thickness of the patties being stacked.

By way of example, in an embodiment of the invention, conveyor 13 moved at a speed of about 0.6 feet per second, conveyor 12 moved at a speed of about 1.2 feet per second, and each of the six conveyors 14 moved at a speed of about 3.25 feet per second.

Each stacking station 10 includes an open top, open bottom, vertically-extending metal stacking cylinder 26 containing a vertically-movable stack supporting plunger 34 that is stepped vertically downward as patties 11 enter a cylinder 26. A patty detector 28,29 is associated with each fast conveyor 14 that feeds each stacking cylinder 26. While the detector 28,29 of an embodiment of the invention utilized an LED light source 28 and a phototransistor 29 as shown in FIG. 1, it is within the spirit and scope of the invention to use other types of detectors; for example, light or sound reflection detectors, capacitance detectors, and/or detection by way of mechanical feelers. Detector 28,29 detects passage of a patty 11 on its way to a stacking cylinder 26, and operates to feed a patty-detected signal 24 to an electronic controller 35, shown in FIG. 4. Controller 35 is of a well-known design, and will not be described in detail herein. As a result, controller 35 operates to move the associated plunger 34 vertically downward a distance generally equal to the vertical thickness of a patty 11.

Figure 4:
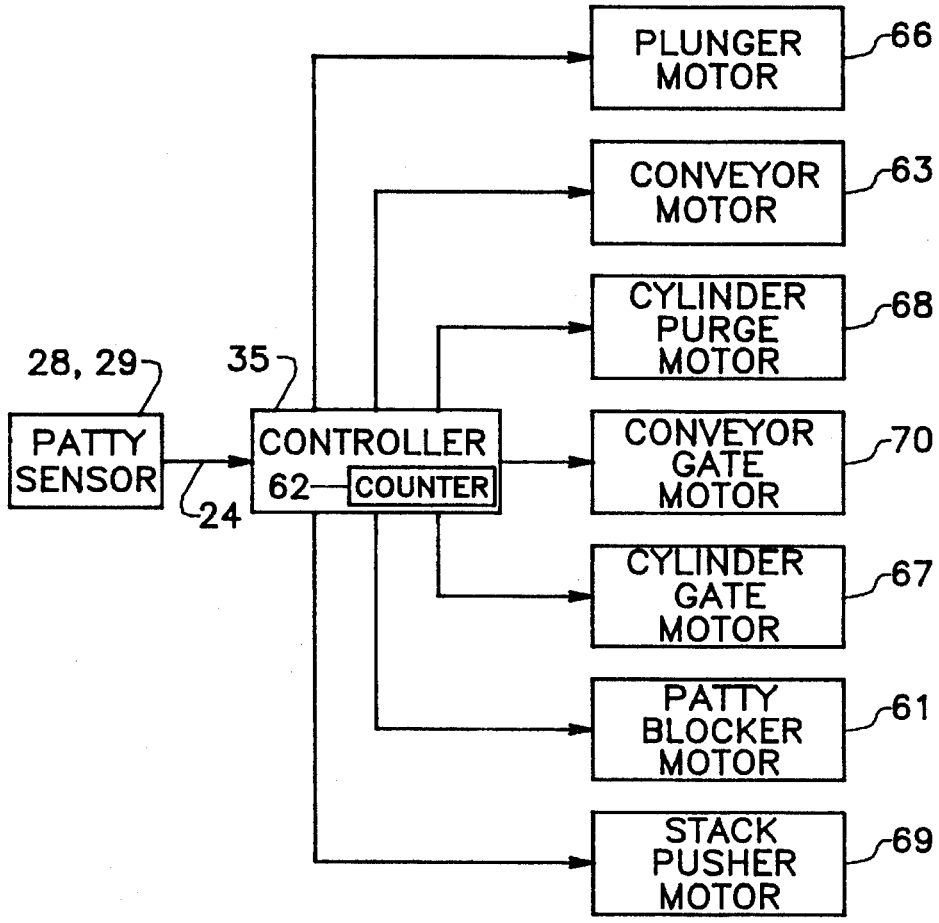
FIG. 4 shows the controller that controls operation of each of the six stacking stations, one station of which is shown in FIG. 1.

When a given number of patties 11, as is manually set or selected by an operator at controller 35 of FIG. 4, have been stacked in a cylinder 26, as is determined for example by counting the output signals from patty detector 28,29, a patty-blocking member 40 that is associated with the fast conveyor 14 feeding that cylinder 26 is operated by controller 35 to block passage of patties 11 along that fast conveyor 14, gate 44 raises vertically, and lid 43 retracts horizontally. The plunger 34 in that cylinder 26 is now raised out of the top of the cylinder to the vertical height of a stage platform 41. This top position of plunger 34 is shown in dotted lines in FIG. 1. A stack pusher member 42 now pushes the accumulated stack of patties horizontally off of elevated plunger 34 and onto stage platform 41.

Plunger 34 is thereafter lowered to position 71, lid 43 is moved horizontally to the left, to again extend over cylinder 26, gate 44 drops vertically down and out of the way of patty flow, patty blocking by 40 is disabled, and patty stacking begins again in cylinder 26.

As features of the invention (1) a resilient spring or force member 30 is associated with the right-hand exit end of each fast conveyor 14, to cooperate with or brush against the top surface of each passing patty 11, (2) horizontally-extending and movable lid 43 is associated in horizontal spaced relation with the top open end of each stacking cylinder 26, and (3) the top right hand vertical side wall of each stacking cylinder 26 (i.e., the wall that is positioned downstream of patty movement) includes a vertically-extending patty impact lip 27. All three of the above features aid in the orderly stacking of patties 11 in a cylinder 26.

As a feature of the invention, the above-mentioned controller 35 operates to move lid 43 horizontally to the side before a patty stack is elevated to stage platform 41, and lid 43 is moved back into place over the open top of a cylinder 26 when stacking begins again.

As another feature of the invention, the left-hand upstream vertical side wall of each cylinder 26 (i.e., the side from which patties 11 enter a cylinder 26) includes a vertically-movable gate, or wall member 44, that is moved up into the patty flow path as patty flow to a cylinder 26 is blocked by operation of patty blocking member 40. In its raised position, gate 44 acts as a guide to keep the stack of patties vertically stable as the stack is raised to the level of stage platform 41. Again, this gate 44 is moved back into place adjacent to the side of a stacking cylinder 26 when stacking begins again.

A feature of the invention provides a cylinder purge cycle wherein any patties in a cylinder 26 are selectively gravity-purged vertically downward to a discard station or container 46. On initial apparatus startup, a cylinder purge is performed before the above-described patty stacking begins. Thereafter, the output of the abovementioned patty detector 28,29 is monitored to determine if one or more patties 11 are blocking a patty-sensing station 28,29. This event is detected, for example, by sensing that the absence of a patty 11 at station 28,29 has not been detected. When such a detector 28,29 blocking event is detected, it is determined that a patty flow malfunction has occurred, and that a cylinder purge cycle should be performed. More specifically, when an excessive time interval passes before patty sensor 28,29 indicates that a patty 11 has successfully passed sensing station 28,29, patty-blocking member 40 is activated, and the fast conveyor 14 that is associated with that patty sensor 28,29 is stopped. The plunger 34 in the associated stacking cylinder 26 is now moved to a position slightly below the bottom end of the cylinder (as shown in dotted line in FIG. 1), and cylinder 26 is moved horizontally to the right a short distance to a location (also shown in dotted lines in FIG. 1) overhanging a sloped, vertically extending, purge chute 47. Any patties 11 now resident in that cylinder 26, gravity-fall vertically downward out of the bottom of the cylinder, and are guided by chute 47 to the location of patty discard station 46. That cylinder 26 is now moved horizontally back into stacking position, the fast conveyor 14 associated therewith is started for a time period to purge that fast conveyor, the above-described cylinder purge operation or cycle is repeated, associated counters and timers are reset, and patty blocking member 40 is deactivated, to thereby again begin patty stacking in the cylinder 26.

Figure 8:
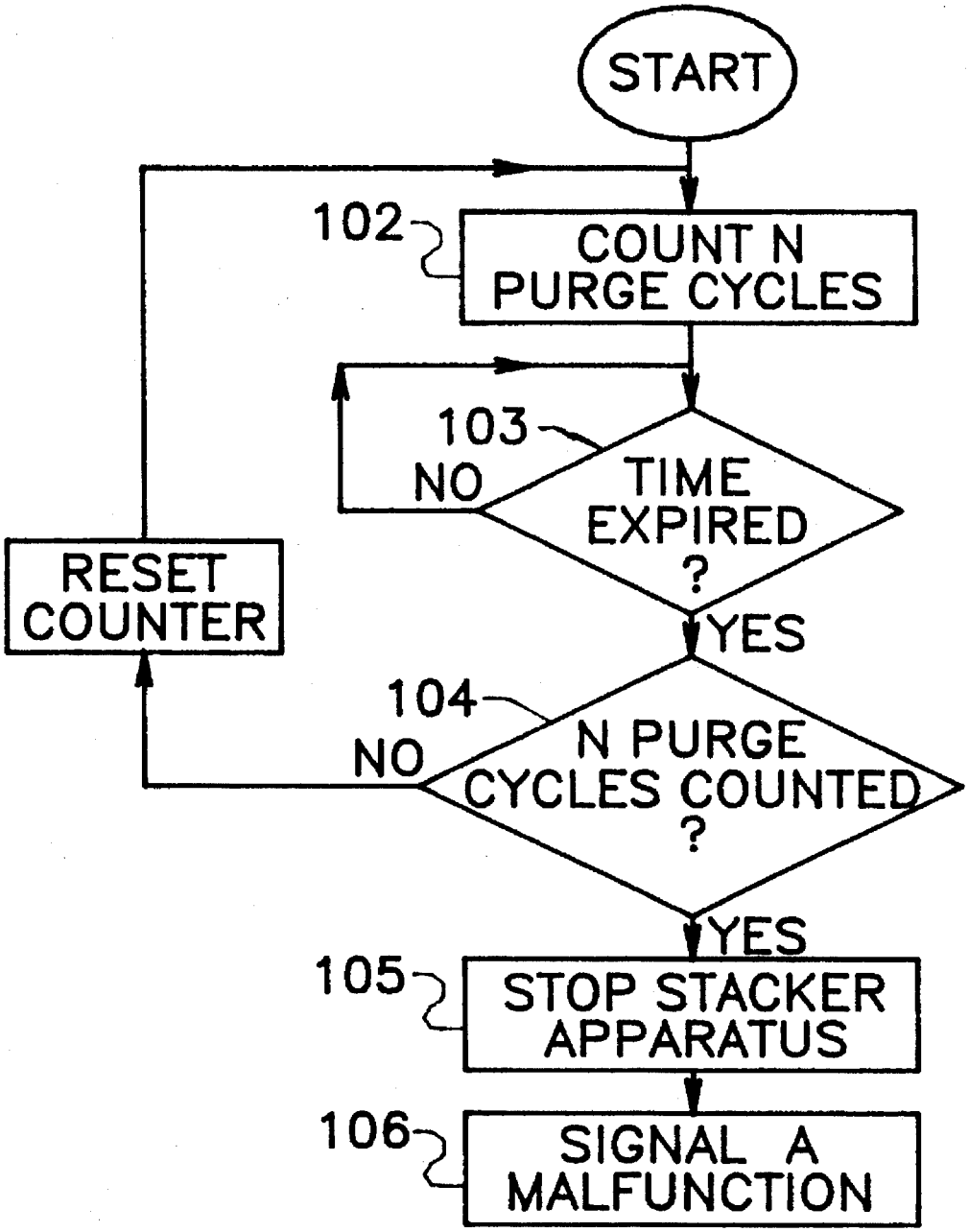
FIG. 8 shows a feature of the invention whereby the controller of FIG. 4 operates to indicate a stacker station malfunction when an excessive number of purge cycles, as shown in FIG. 7, are performed in a given time interval.

In association with the above-mentioned cylinder purge operation, the invention operates to automatically indicate an apparatus malfunction if too many purge cycles are performed in a given time period as is shown in FIG. 8.

Figure 2:
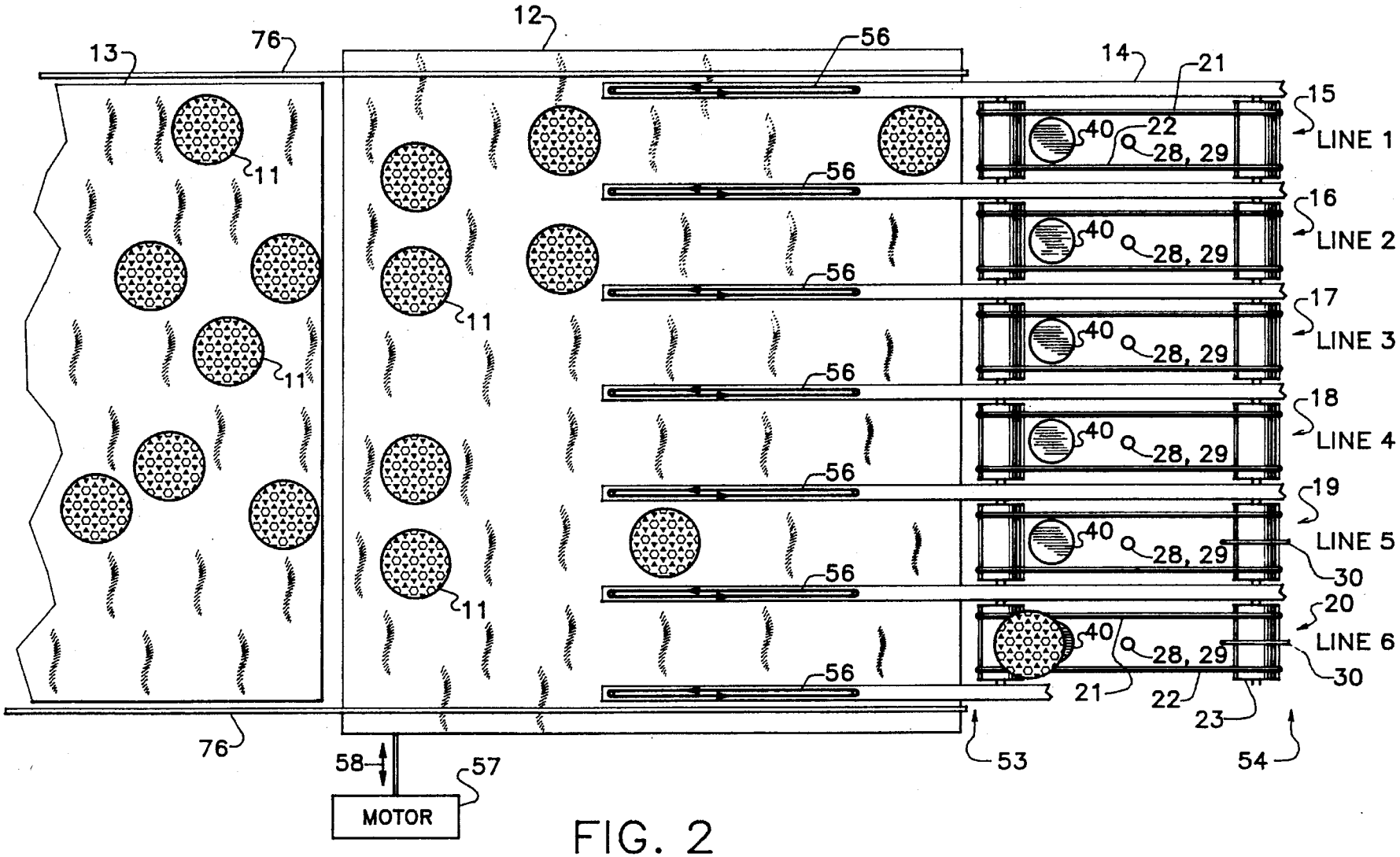
FIG. 2 is a top view of a left-to-right conveying arrangement showing a generally horizontal and slow speed belt conveyor that feeds the horizontal intermediate speed belt conveyor shown in FIG. 1, which intermediate speed conveyor feeds six horizontal and high speed belt conveyors, one of which is associated with each of the six stacking modules, and one of which is shown in side view in FIG. 1.

While the invention has general utility, it is described in detail in relation to the stacking of frozen hamburger, or sausage patties 11, as these patties are received from a freezing process on warehouse conveyor 13 of FIG. 2. Patties 11 are supplied to conveyor 13 in a somewhat random fashion, as shown. Slow conveyor 13 feeds patties 11 to a faster conveyor 12, and then to six yet faster conveyors 14, thus operating to horizontally spread out, or separate, a serial stream of patties 11, so as to make the patties easier to stack at the six stacking stations 10, one station of which is shown at FIG. 1. Vertical and parallel walls 76 are associated with the conveyor system 13, 12, 14.

Figure 3:
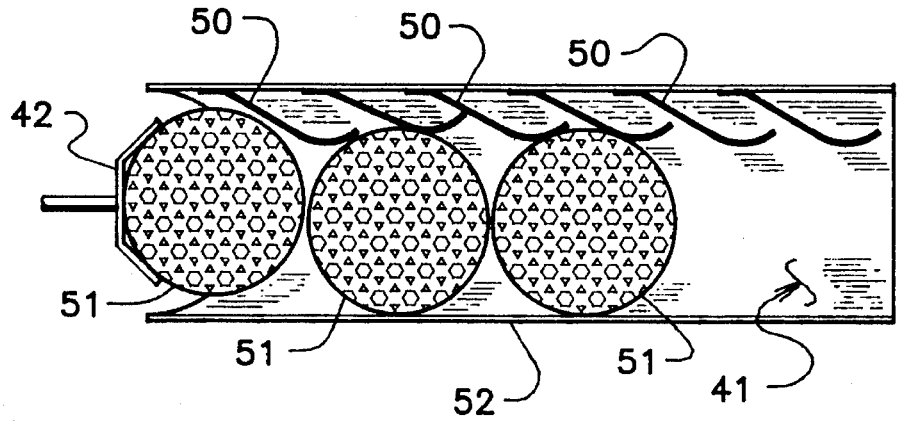
FIG. 3 is a top view of the stack output stage platform shown in FIG. 1.

As shown in FIGS. 1 and 3, a number of resilient and vertically-extending leaves 50 of sheet metal engage the vertical side, or sides of a patty stack 51 as the stack is moved onto stage platform 41 by stack pusher 42. This operation aligns stacks 51, as shown in FIG. 3, and holds the stack 51 in place against a front, relatively high, stationary, vertical side wall 52 of stage platform 41. While only one side set of vertical leaves 50 is shown in FIGS. 1 and 3, it will be understood that front wall 52 may carry a like configuration of leaves 50, if desired. When a second patty stack 51 is pushed onto stage platform 41, the first stack 51 is shoved onto stage platform 41 by engagement with the leading edge vertical side of the second stack 51. When three patty stacks (or a chosen number of patty stacks) 51 have been thus accumulated on stage platform 41, the patty stacks are moved off of stage platform 41 into a receiving area (not shown), this work flow function being shown in FIG. 6.

A number of the above-described stackers 10 (for example, six) operate in parallel, receiving patties 11 from warehouse conveyor 13. FIG. 2 is a top view of the physical configuration of these three series conveyor systems 13,12, 14. In FIG. 2, the six fast conveyors 14 are individually identified, both by reference numerals 15–20 and by the legends line 1 thru line 6. For purposes of simplicity, the side view of FIG. 1 shows only the fast conveyor 20 that is associated with line 6.

Each of the fast conveyors 15–20, as seen in FIG. 2, may be comprised of two, three or four spaced conveyor belts, two belts of which are shown at 21 and 22. This configuration of two spaced belts 21,22 provides an intermediate space for placement and operation of the six patty blocking members 40, and also provides space for operation of the six patty detectors 28,29.

To provide a patty movement perspective, FIG. 2 shows in dotted line a patty 11 being transported by fast conveyor 20. Belts 21,22 of each fast conveyor operate at generally the same linear speed; for example, 3.25 feet per second. As a feature of the invention, the two spaced belts 21,22 may operate at slightly different linear speeds, thus causing a patty 11 to rotate as it is transported from the input end 53 to the output end 54 of a fast conveyor 14. In the event that the patty is defective in that it is broken, this rotation of the broken patty will cause the patty to drop vertically down between belts 21,22 to a discard area (not shown). Without limitation thereto, in an embodiment of the invention, the horizontal distance between the input end 53 and the output end 54 of each fast conveyor 14 was in the range of about 12 to about 18 inches.

In the event a fast conveyor 14 becomes blocked, either accidentally or intentionally, patties 11 that are moving on their way to that fast conveyor will stack up at the input end 53 of that fast conveyor. A feature of the invention provides patty-diverting means 56 intermediate to each of the fast conveyors 14. Operation of patty diverter means 56 causes patties to automatically spill over to one or more adjacent fast conveyors 14 when entry to a fast conveyor 14 is temporarily blocked. As shown in FIG. 2, in an embodiment of the invention, patty-diverter means 56 comprises driven rollers, or belts 56, whose running surfaces extend perpendicular to the belt runs of conveyors 12 and 14.

As an additional feature of the invention, a motor 57 may be provided to cause conveyor 12 to oscillate horizontally sideways, as shown by arrow 58, to assist in patty distribution to the six fast conveyors 14. By way of example, sideways movement of conveyor 12 may be in the range of about ½ the horizontal width of a patty 11; for example, up to about 2½ inches.

Operation of the invention will now be described while making reference to the various drawing figures. As shown in FIG. 1, a patty 11 is transported at a speed of about 1.2 feet per second by belt conveyor 12, as the patty approaches the input end 53 of a faster belt conveyor 14 that is driven at about 3.25 feet per second by a motor 63. In FIG. 1, patty-blocking member 40 is shown in its lowered and inactive position. Arrow 60 shows that upon energization of motor 61, blocking member 40 will be moved upward to the dotted line position, thus physically blocking movement of a patty 11 by fast conveyor 14.

A patty detector, comprising an LED light source 28 and an upward-spaced phototransistor 29 or a similar detecting device, is located downstream of patty-blocking member 40. As is well known, LED source 28 provides a generally vertical light beam that is detected by phototransistor 29. When this light beam is broken, passage of a patty 11 on its way to conveyor output end 54 is indicated. As shown in FIG. 4, controller 35 includes a resettable counter 62 that operates to count the number of patties that pass sensing station 28,29, as a stack of patties is being formed in stacking cylinder 26. Once a complete stack is formed in cylinder 26, certain operations are performed, as will be described, and counter 62 is reset to zero.

As a patty 11 exits conveyor 14, the upper surface thereof is brushed by a force member 30. This slight force on the patty stabilizes stacking of the patty in closely-adjacent cylinder 26. While not critical to the invention, in an embodiment thereof, force member 30 comprised a tube of polyurethane having an inner diameter of about 3/32 inch and an outer diameter of about 5/32 inch. This tube 30 was mounted so as to engage the center of the driven exit roller 23 of fast conveyor 14 (also see FIG. 2), as tube 30 was bent to form about a 90-degree arc or turn.

Cylinder 26 preferably comprises a cylinder of a horizontal cross-sectional area that is only somewhat larger than the cross-sectional area of a patty 11. The cross-sectional shape of cylinder 26 is not critical to the invention; for example, it can be circular, square, or rectangular in cross section. The top and bottom ends 64 and 65 of each cylinder 26 are open, and a plunger 34 is vertically movable along a vertical axis that is defined by cylinder 26 by operation of a motor 66.

Plunger 34 is preferably formed of metal, and includes a horizontally extending, patty supporting, top member of generally the same horizontal shape as the cross section of cylinder 26, but being somewhat smaller in size to allow free movement of plunger 34 throughout the vertical height of cylinder 26.

FIG. 1 shows three positions of plunger 34; i.e., an upper dotted line position wherein the top of plunger 34 is horizontally aligned with stage platform 41, a lower dotted line position wherein plunger 34 is withdrawn out of the bottom end 65 of cylinder 26, and a solid line position wherein the top of plunger 34 is positioned slightly below the top of end 64 of cylinder 26 in horizontal position to receive the first patty 11 of a stack.

As a patty 11 enters a cylinder 26, the right-hand leading edge of the patty engages a vertically-extending abutment, or lip 27, that is formed as an integral portion of the downstream side or wall of cylinder 26. In addition, as shown in FIG. 1, a generally horizontal lid 43 is in position over the top end 64 of cylinder 26 during patty stacking. These two above-described features 27 and 43 aid in the orderly stacking of patties in cylinder 26.

As patties are added to the patty stack that is being formed within cylinder 26, controller 35 operates to step control motor 66 so as to maintain the top surface of the stack generally at the horizontal position 71 shown for the top surface of plunger 34 in FIG. 1. In this manner, all of the patties within the stack encounter generally the same stacking dynamics, and reliable stacking is achieved by the invention.

Figure 5:
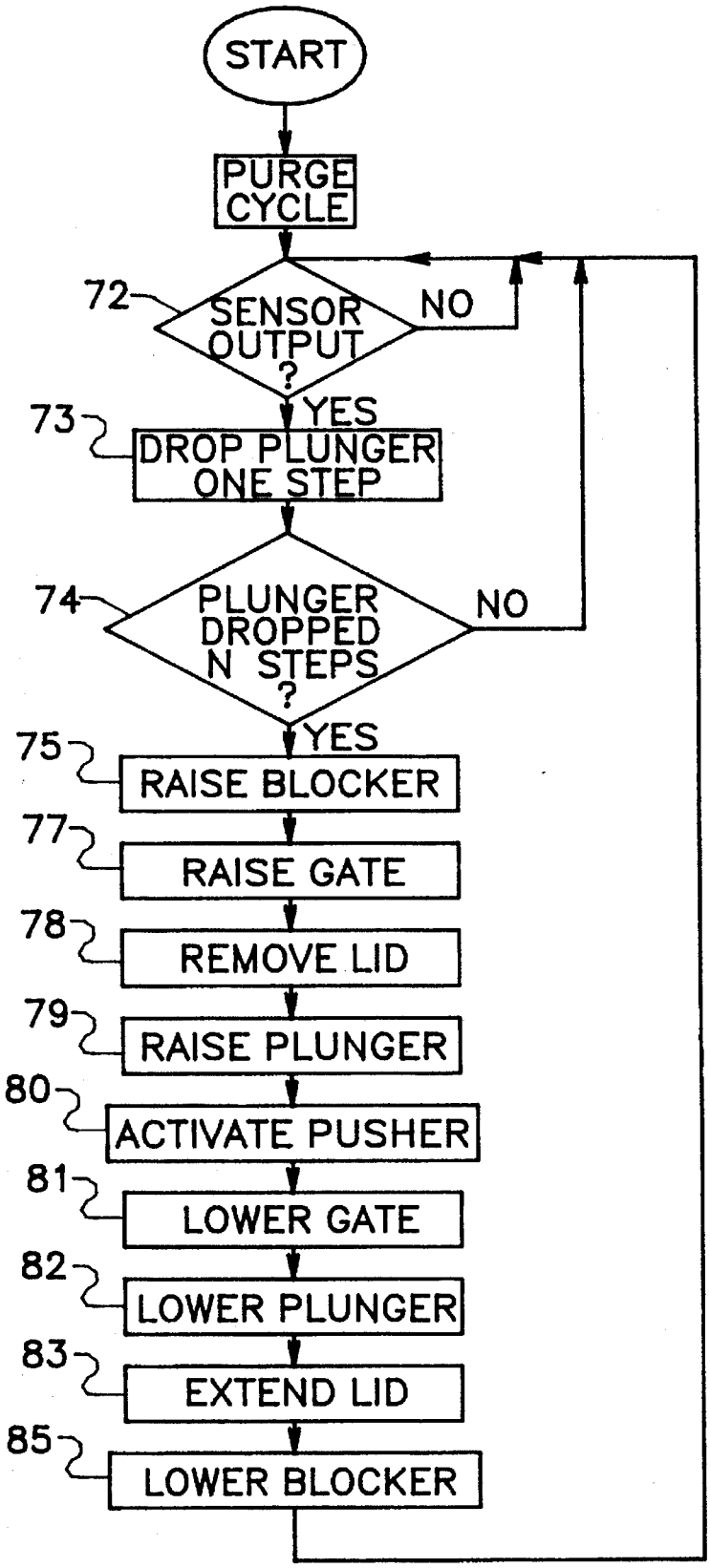
FIG. 5 shows the work flow of the controller of FIG. 4 as the various components of the stacking station of FIG. 1 are controlled.

With reference to FIGS. 1, 4 and 5, the abovedescribed stacking operation is controlled by controller 35, as this controller receives signals 24 from patty sensor 28,29, and uses these signals to control the various motors shown in FIGS. 1 and 4. Within the spirit and scope of the invention the motors of FIGS. 1 and 4 may be any type of known actuating motor; for example, pneumatic or electrical.

FIG. 5 shows that the work flow of controller 35 includes a decision block 72 whereby an output from sensor 28,29 is monitored. When passage of a patty 11 is indicated, block 73 operates to drop plunger 34 one step. In this way, the top of the patty stack is maintained generally at position 71 shown in FIG. 1. Decision block 74 now tests to determine if the plunger has dropped N steps; for example, fourteen steps. If no, then cycle 72,73,74 is repeated.

While the invention will be described making reference to plunger 34 dropping one step per patty, it is within the spirit and scope of the invention to drop plunger 34 somewhat more than the thickness of one patty for a given number of patties, and to then leave the plunger's vertical position unchanged for the stacking of two successive patties.

Once a stack of a chosen number of patties 11 (for example, fourteen patties) have been placed in cylinder 26, controller 35 controls motor 61 of FIGS. 1 and 4 so as to raise patty-blocking member 40 horizontally into the dotted line position shown in FIG. 1, thus blocking movement of patties along fast conveyor 14, as is shown by function block 75 of FIG. 5.

Generally coincident therewith, function blocks 77 and 78 operate to raise gate 44 to its dotted line position, and move lid 43 to the right; i.e., operation of controller 35, by way of function blocks 75 and 77, controls motors 70 and 67 to move gate 44 vertically upward to a position to block the flow path of patties 11 into cylinder 26, and to guide the stack of patties as the stack is elevated to the position of stage platform 41, and move lid 43 horizontally to the right and away from the top end of cylinder 26.

Controller 35 next operates in accordance with function block 79 to raise plunger 34 to its upper dotted line position whereat the top surface of plunger 34 is substantially in horizontal alignment with the top surface of stage platform 41. Once plunger 34 is thus positioned, motor 69 is controlled in accordance with function block 80 to move stack pusher member 42 to the right, thereby causing a stack of patties supported by plunger 34 to enter stage platform 41, as is shown at 51 in FIG. 3.

Once this function 80 has been accomplished, function block 81 controls motor 70 to lower gate 44 to the position shown in FIG. 1 so as to no longer block patty flow to cylinder 26, function block 82 controls motor 66 to lower the top surface of plunger 34 to position 71 shown in FIG. 1, function block 83 controls motor 67 to replace lid 43 over the top end 64 of cylinder 26, as shown in FIG. 1, and function block 85 controls motor 61 to lower patty blocking member 40 to the position shown in FIG. 1. Patty stacking in cylinder 26 now begins again.

While not shown, it is within the spirit and scope of the invention to provide movement and/or position sensors for the various motors and mechanical members to ensure that the various functions of FIG. 5 are successfully accomplished prior to the initiation of other functions of FIG. 5.

With reference to FIGS. 1 and 3, the orderly movement of stacks of patties 51 onto stage platform 41 is achieved by the use of vertically-disposed metal spring leaves 50 that engage one, or both, vertical sides of the stacks 51. In FIG. 3, one side of a stack 51 cooperates with the leaves 50, whereas the opposite side of the stack 51 is pushed against a vertical wall 52 that is higher than stack 51. As shown in FIG. 1, as an enhancement of this feature of the invention, each of the leaves 50 may comprise a number of vertically-stacked leaves; for example, four leaves of generally similar construction.

Figure 6:
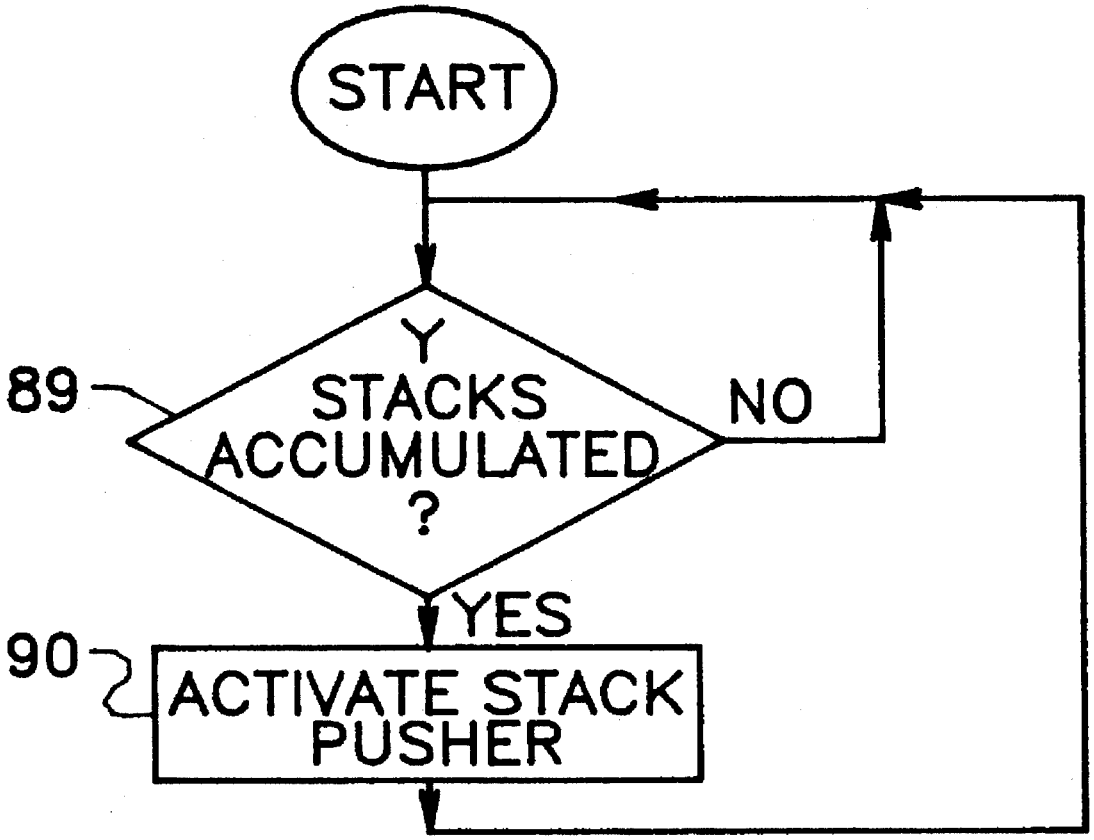
FIG. 6 shows the work flow of the controller of FIG. 4 when it is determined that the stage platform of FIGS. 1 and 3 has accumulated a given number of stacks.

With reference to FIGS. 1, 3 and 6, controller 35 operates to count the number of stacks that have been placed on stage platform 41 by a stacking module or station 10. Decision block 89 of FIG. 6 shows that when Y stacks 51 of patties (for example, three patty stacks) have been accumulated on stage platform 41, function block 90 is enabled, and motor 69 of FIG. 1 is energized to move stack pusher member 42 to the right, thereby causing all Y stacks on stage platform 41 to be moved off of the stage platform into an boxing or handling area (not shown). Plunger 34 moves back to stacking position within cylinder 26 as soon as a patty stack is moved therefrom onto stage platform 41. Patty stacking at this stacking station 10 may continue as the above operation is performed.

Figure 7:
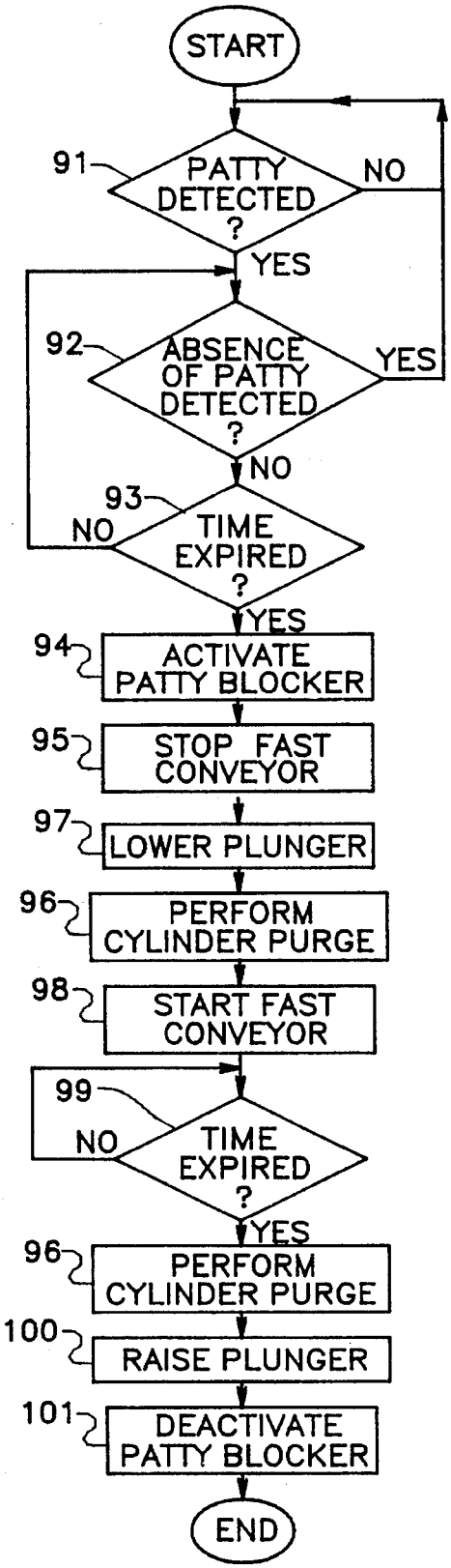
FIG. 7 shows the purge cycle work flow of the controller of FIG. 4 when the output of the patty sensing phototransistor of FIG. 1 indicates that one or more patties are blocking the patty sensing station.

A feature of the invention provides for the purging of a cylinder 26 when the patty sensor 28,29 associated therewith indicates a patty flow problem; for example, a patty jam on the associated fast conveyor 14. The work flow of controller 35 that is shown in FIGS. 7 and 8 show this feature.

Decision block 91 first operates to monitor the output of patty sensor 28,29 of FIG. 1. If passage of a patty is detected, then decision block 92 looks for the subsequent detection of the absence of a patty at sensor 28,29. If event 92 is not detected, then decision block 93 times the interval between events 91 and 92. When time period 93 has expired, it is assumed that blockage of patty flow on the associated fast conveyor 14 has occurred, and function block 94 then operates to control motor 61 of FIG. 1 to cause the patty blocking member 40 for that fast conveyor 14 to be activated; i.e., raised. In addition, function block 95 stops that fast conveyor by deenergizing its motor 63, and function block 97 energizes motor 66 of FIG. 1 to move plunger 34 to its lowermost position out of or adjacent to the bottom end 65 of cylinder 26.

A cylinder purge operation is now performed by function block 96, as above described. In summary, this purge operation consists of energizing motor 68 to move cylinder 26 to the right; i.e., to the dotted line position shown in FIG. 1. In this position of cylinder 26, all patties in the cylinder are gravity dumped onto chute 47, and then into a discharge or discard area 46. After a given time interval, motor 68 is energized to restore cylinder 26 to the position shown in FIG. 1. Function block 98 now operates to energize conveyor motor 63, thus causing all patties that are down stream of patty-blocking member 40 to empty into cylinder 26. After the expiration of a time interval, as shown at 99, the above-mentioned cylinder purge cycle is repeated.

When cylinder 26 is thereafter back in its normal stacking position shown in FIG. 1 (i.e., after this second purge cycle 96), function block 100 operates to raise plunger 34 to the position shown in FIG. 1, function block 101 operates to lower patty blocking member 40, associated counters and timers are reset, and the stacking of patties 11 within that cylinder 26 begins again.

The above-described cylinder purge feature includes the feature of FIG. 8 wherein controller 35 operates to indicate a malfunction of a stacking station 10 if that station experiences an unusually high number of cylinder purge cycles within a given time interval. More specifically, controller 35 operates in accordance with function block 102 to count the number of purge cycles. When this number exceeds a given number N within a time, as determined by decision block 103, decision block 104 operates to stop all stacking operations at that stacking station 10, as indicated by function block 105, and function block 106 signals or indicates that this stacking station 10 has experienced a malfunction.

From the above detailed description of preferred embodiments of the invention it can be seen that an automatic stacking apparatus 10 having general utility has been provided, the stacking apparatus being especially useful for stacking frozen hamburger and sausage patties 11 as these patties are received from a freezing process. A slow conveyor 12 feeds the patties to a fast conveyor 14, the fast conveyor operating to horizontally spread out, or separate, the serial stream of patties so as to make them easier to stack. The fast conveyor delivers the patties to a vertical stacking chamber 26 whose top opening 64 is located generally on the same vertical level as the output of the fast conveyor. A resilient force member 30 brushes the top of the patties as they exit the fast conveyor and enter the stacking chamber, thereby absorbing energy and preventing the patties from rotating downward or bouncing as they enter the stacking chamber. A vertically-movable plunger 34 in the stacking chamber automatically lowers as each patty is delivered to the stacking chamber, so that the top of a stack in the stacking chamber is maintained generally level with, or a given distance below, the output 54 of the fast conveyor. An LED light source 28 and photodetector 29 operate to count the number of patties entering the stacking chamber. When a complete stack has been accumulated on the plunger, the plunger raises the stack to the level of a stage platform 41, where they are pushed onto the stage platform. The fast conveyor is temporarily blocked while this operation occurs.

A number of resilient, vertically-disposed leaves 50 of sheet metal engage the side, or sides of a stack 51, as the stack is moved onto the stage platform. This operation aligns the stack, and holds the stack in place on the stage platform. When a second stack is pushed onto the stage platform, the first stack is shoved by the second stack. When the exemplary three stacks have been accumulated on the stage platform, the three stacks are moved off of the stage platform into a receiving area.

A purging operation, as described in detail above, takes place after an event, such as a fast conveyor jam occurs. For this purge operation, the plunger retracts to its lowermost position, and the stacking chamber is moved horizontally off of the plunger. Any patties then in the stacking chamber now drop down a purge chute 47. The patties are temporarily blocked on the fast conveyor while this purge operation takes place.

A number of the above-described stackers operate in parallel, receiving patties from a warehouse conveyor 13. In the event a fast conveyor becomes blocked, the patties intended for that conveyor will stack up at the input of that fast conveyor, and will then automatically spill over to an adjacent fast conveyor. Rollers or conveyors 56 operating on vertical axes may be used at the input ends 53 of the fast conveyors to aid in the diverting of patties from the input of a fast conveyor to the input of an adjacent fast conveyor. In this configuration of the invention, the slow conveyor 12 may oscillate sideways to assist in patty distribution to the plurality of fast conveyors.

While this invention has been described in detail while making reference to various embodiments thereof, it is recognized that those of skill in the art will readily visualize yet other embodiments that are within the spirit and scope of the invention. Thus, the forgoing description is not to be taken as a limitation on the spirit and scope of the invention.

What is claimed is:

1. Stacker apparatus for use in vertically stacking a plurality N of flat objects, each object having generally the same horizontal shape, and each object having generally the same vertical thickness, comprising;

a vertically extending and elongated cylinder having a cross section generally the same as said horizontal object shape, and having an open bottom and an open top, a vertically-movable plunger within said cylinder, first control means for moving said plunger upward adjacent to said top of said cylinder, conveying means for conveying a serial stream of said objects to said top of said cylinder, second control means responsive to said objects serially entering said top of said cylinder, and operable to move said plunger vertically downward within said cylinder in steps generally equal to said uniform vertical thickness so as to establish a vertical stack of objects within said cylinder whose top is positioned generally coincident with said top of said cylinder, third control means responsive to N objects entering said cylinder and operable to interrupt said conveying means, fourth control means including said first control means responsive to N objects entering said cylinder and operable to cause said plunger to move vertically upward so as to elevated said N objects above said top of said cylinder, and means responsive to said plunger in said vertically-upward position, and operable to remove said elevated stack of N objects from said plunger.

2. The apparatus of claim 1 including;

force means for engaging a top surface of said objects as said objects leave said conveyor and enter said cylinder.

3. The apparatus of claim 1 including;

means for detecting failure of objects to leave said conveyor and enter said cylinder, fifth control means including said second control means responsive to said detecting means detecting said failure for causing said plunger to move vertically down to a position generally coincident with said bottom of said cylinder, a purge chute located at a position that is horizontally spaced from said bottom of said cylinder at a vertical height that is generally coincident with said bottom of said cylinder, and sixth control means responsive to said detecting means detecting said failure and responsive to said plunger in said vertically down position for moving said cylinder horizontally to said location of said purge chute.

4. Apparatus for stacking a serial stream of generally planar items that are produced at a first rate at an item processing output, comprising;

a generally horizontal conveyor having an input positioned for receiving said items from said processing output, said conveyor transporting said items to a conveyor output at a speed that is higher than said first rate, sensing means for sensing movement of each of said items past a point on said conveyor that is intermediate said conveyor input and said conveyor output, a stacking assembly including a vertical chamber and a vertically-movable item supporting plunger located within said chamber, said chamber having a generally open top end that is located adjacent to said conveyor output, and said plunger being operable to support a vertical stack of items thereon, a controller responsive to said sensing means and operable to move said plunger vertically downward in a manner to maintain a top of said stack of items on said plunger in a position for receiving items from said conveyor output, first function means of said controller for blocking items from being transported by said conveyor in response to a given number of items being accumulated in a stack on said plunger, an output stack receiver, and second function means of said controller operable in response to said given number of items being accumulated in a stack on said plunger for moving said plunger vertically upward out of said open top end of said chamber, and for thereafter moving said stack of items on said plunger to said output stack receiver.

5. The apparatus of claim 4 wherein said chamber includes a generally open bottom end, and including;

an item purge area, and third function means of said controller and operable in response to said sensing means sensing failure of said items to move past said point on said conveyor for moving said plunger vertically downward out of said open bottom end of said chamber, and for thereafter moving items on said plunger to said purge area.

6. The apparatus of claim 5, including;

a plurality of said generally horizontal conveyors and a like plurality of said stacking assemblies, said plurality of stacking assemblies having a common output stack receiver and a common purge area.

7. The apparatus of claim 4 including;

resilient force means associated with said output of said conveyor and operable to physically engage a top surface of each of said items as an item passes from said output of said conveyor to said top open end of said chamber.

8. The apparatus of claim 7 wherein said chamber includes a generally open bottom end, and including;

an item purge area, and third function means of said controller operable in response to said sensing means sensing failure of said items to move past said point on said conveyor for moving said plunger vertically downward to a position adjacent to said open bottom end of said chamber, and for thereafter moving said chamber and items on said plunger to said purge area.

9. The apparatus of claim 8, including;

a plurality of said generally side-by-side horizontal conveyors and a like plurality of said stacking assemblies, said plurality of stacking assemblies having a common output stack receiver.

10. The apparatus of claim 9, including;

item diverter means at said input end of each of said plurality of conveyors operable to divert items to an adjacent conveyor in the event a conveyor jams and fails to convey items.

11. The apparatus of claim 10 wherein said plurality of side-by-side conveyors are relatively narrow conveyors that feed items in a similar direction to said like plurality of stacking assemblies, including;

a relatively wide conveyor feeding items in said similar direction to an input end of said plurality of relatively narrow conveyors, and means operable to produce oscillator movement of said relatively wide conveyor in a direction generally normal to said similar direction.

12. The apparatus of claim 11, including;

a plurality of item diverter means, each individually located at said input end of one of said plurality of relatively narrow conveyors, and operable to divert items to an adjacent relatively narrow conveyor in the event that the feeding of items by a relatively narrow conveyor becomes jammed.

13. A method of vertically stacking a given number of flat objects, said objects being generally of the same horizontal shape and generally of the same vertical thickness, comprising the steps of;

providing a hollow, vertically-extending stacking chamber having an open top and having a horizontal cross section generally the same as said horizontal shape of said objects, feeding a serial horizontal stream of said objects to said open top of said chamber, providing a vertically-movable plunger in said chamber upon which said objects in said chamber, moving said plunger vertically downward so as to maintain a last object to enter said chamber at generally at said top of said chamber as objects are serially delivered to said chamber, providing a resilient force member positioned to brush against said objects as they are in the process of entering said top of said chamber, thereby absorbing energy from said objects as said objects enter said chamber, providing an object detector operable to count the number of objects entering said chamber, detecting when said given number of objects have been stacked on said plunger, responding to said detecting step and stopping said serial feed of objects to said chamber and raising said plunger out of said open top of said chamber, and removing said stack of said given number of objects from said raised plunger.

14. The method of claim 13 including the steps of;

providing a slow horizontal conveyor operable to feed said objects to a fast horizontal conveyor, said fast conveyor operating to horizontally separate said serial stream of objects, and arranging said fast conveyor to deliver said serial stream of objects to said top of said chamber.

15. The method of claim 14 wherein said step of stopping said serial feed of objects to said chamber includes stopping said fast conveyor.

16. The method of claim 15 including the steps of;

detecting failure of said objects to be fed by said fast conveyor, and responding to said failure to feed detection by stopping said fast conveyor and purging said chamber of any objects that may be therein.

17. The method of claim 16 wherein said chamber includes an open bottom and wherein said purging step includes the steps of;

moving said plunger adjacent to said bottom of said chamber, and moving said chamber to an object purge location.

18. The method of claim 17 including the steps of;

determining the number of said movements of said chamber to said object purge location that occur in a given time interval, and indicating a malfunction condition when said number exceeds a given level.

19. The method of claim 14 wherein said slow conveyor is a relatively wide conveyor that feeds objects in a given direction, and including the steps of;

providing a plurality of relatively narrow and side-by-side fast conveyors each of which delivers a serial stream of objects to the top of a like plurality of chambers, and providing oscillator movement of said slow conveyor in a direction generally normal to said given direction.

20. The method of claim 19 including the step of;

providing object diverter means at a position whereat said slow conveyor delivers objects to said plurality of fast conveyors to divert items to an adjacent fast conveyor in the event that a conveyor fails to convey items.

* * * * *